US007900852B2

(12) United States Patent
Feenstra

(10) Patent No.: US 7,900,852 B2
(45) Date of Patent: Mar. 8, 2011

(54) COVER FOR PROTECTING A FUSIBLE LINKAGE IN A SPRINKLER HEAD

(75) Inventor: Shawn Feenstra, Caledonia, MI (US)

(73) Assignee: The Viking Corporation, Hastings, MI (US)

( * ) Notice: Subject to any disclaimer, the term of this patent is extended or adjusted under 35 U.S.C. 154(b) by 214 days.

(21) Appl. No.: 12/207,245

(22) Filed: Sep. 9, 2008

(65) Prior Publication Data

US 2010/0059235 A1 Mar. 11, 2010

(51) Int. Cl.

| | |
|---|---|
| ***B05B 1/28*** | (2006.01) |
| ***B05B 15/04*** | (2006.01) |
| *B65D 85/42* | (2006.01) |
| *B65D 41/00* | (2006.01) |

(52) U.S. Cl. ..... 239/288; 239/288.5; 206/418; 220/724; 169/37

(58) Field of Classification Search ..... 169/37–40, 169/90; 239/288–288.5

See application file for complete search history.

(56) References Cited

U.S. PATENT DOCUMENTS

| | | | | |
|---|---|---|---|---|
| 1,230,469 | A | 6/1917 | Esty | |
| 2,890,758 | A | 6/1959 | Pfalzgraff et al. | |
| 3,388,747 | A | 6/1968 | Hodnett | |
| 3,727,695 | A | 4/1973 | Danton | |
| 3,797,746 | A | 3/1974 | Gray et al. | |
| 4,176,756 | A * | 12/1979 | Gellman | 215/274 |
| 5,570,745 | A | 11/1996 | MacDonald, III | |
| 5,632,339 | A | 5/1997 | Fenske et al. | |
| 5,667,017 | A | 9/1997 | Hoffmann et al. | |
| 5,743,337 | A | 4/1998 | MacDonald, III | |
| 5,806,555 | A * | 9/1998 | Magno, Jr. | 137/385 |
| 5,893,418 | A * | 4/1999 | Ponte | 169/37 |
| 6,098,256 | A * | 8/2000 | Poussard | 24/704.1 |
| 6,131,822 | A | 10/2000 | Farmer, Jr. | |
| 6,206,033 | B1 | 3/2001 | Chang et al. | |
| 6,241,092 | B1 | 6/2001 | Vasudeva et al. | |
| 6,669,111 | B2 * | 12/2003 | Vinson et al. | 239/288 |
| D507,328 | S | 7/2005 | Clive et al. | |
| 7,266,979 | B2 * | 9/2007 | Belden, Jr. | 70/57.1 |
| 7,273,189 | B2 * | 9/2007 | Ide et al. | 239/288 |
| 7,290,618 | B2 | 11/2007 | Thomas et al. | |
| 7,757,967 | B1 * | 7/2010 | Yang | 239/288 |
| 2003/0173094 | A1 | 9/2003 | Vinson et al. | |
| 2005/0035022 | A1 | 2/2005 | Ide et al. | |
| 2008/0047718 | A1 | 2/2008 | Orr et al. | |

* cited by examiner

*Primary Examiner* — Dinh Q Nguyen
*Assistant Examiner* — James S Hogan
(74) *Attorney, Agent, or Firm* — Harness, Dickey & Pierce, P.L.C.

(57) ABSTRACT

A combination of a cover and a sprinkler head. The sprinkler head includes a fusible linkage mounted within a frame and having a protruding portion. The cover includes a first member adjacent to the protruding portion of the fusible linkage. The first member has a first connecting end and a first fastening end opposite the first connecting end. A second member is opposite to the first member and has a second connecting end and a second fastening end opposite the second connecting end. The first and second connecting ends are coupled to each other. A first projection and a second projection extend from the first member toward the second member and are in spaced relation to each other for receiving the protruding portion of the fusible linkage.

17 Claims, 5 Drawing Sheets

COVER FOR PROTECTING A FUSIBLE LINKAGE IN A SPRINKLER HEAD

FIELD

The present disclosure relates to a device for protecting fusible linkages used in automatic sprinkler heads.

BACKGROUND

The statements in this section merely provide background information related to the present disclosure and may not constitute prior art.

Historically, automatic sprinklers have been used in automatic fire extinguishing systems to disburse a fluid to control a fire. Typically, the fluid utilized in such systems is water, although systems have also been developed to disburse foam and other materials. Generally, sprinkler heads include a solid metal base connected to a pressurized supply of water, and a deflector used to change the trajectory of the water flow. Alteration of the water flow by the deflector produces a specific spray pattern over a protected area. The deflector is typically spaced from an outlet of the base by a frame. The frame typically has a pair of arms which are disposed in a plane. A fusible linkage typically has a protruding portion which projects in one direction from the plane. The fusible linkage secures a plug seal over a central orifice of the outlet. When the temperature surrounding the sprinkler head is elevated to a predetermined temperature indicative of a fire, a portion of the fusible linkage melts, causing the fusible linkage to disassemble and thus allowing the plug seal to be pushed away from the center orifice by the water pressure in the fire sprinkler piping, resulting in water flow from the center orifice.

To make sure that the fusible linkage melts at the predetermined temperature during a fire, it is important to maintain the designed alignment of the protruding portion of the fusible linkage. During packaging, transport, handling, and installation of sprinkler heads, however, the aforementioned alignment of the fusible linkage may be accidentally disrupted. For example, the protruding portion may be rotated out of its preferred alignment because it is hit by some objects that are external to the sprinkler head.

SUMMARY

In one form, the present disclosure provides in combination a cover and a sprinkler head. The sprinkler head comprises a fusible linkage mounted within a frame. The fusible linkage comprises a protruding portion. The frame comprises a pair of supporting arms. The cover comprises a first member, a second member, a first projection, a second projection, and a space. The first member is adjacent to the protruding portion of the fusible linkage. The first member has a first connecting end and a first fastening end opposite the first connecting end. The first connecting end is adjacent to one of the pair of supporting arms. The first fastening end is adjacent to the other one of the pair of supporting arms. The second member is opposite to the first member and has a second connecting end and a second fastening end opposite the second connecting end. The first and second connecting ends are coupled to each other. The first projection extends from the first member toward the second member. The second projection extends from the first member toward the second member and is in spaced relation to the first projection. The space is defined between the first projection and the second projection for receiving the protruding portion of the fusible linkage.

In another form, the present disclosure provides in combination a cover and a sprinkler head. The sprinkler head comprises a fusible linkage mounted within a frame. The fusible linkage comprises a protruding portion. The frame comprises a pair of supporting arms. The cover comprises a first member and a second member. The first member is adjacent to the protruding portion of the fusible linkage. The first member has a first connecting end and a first fastening end opposite the first connecting end. The first connecting end is adjacent to one of the pair of supporting arms. The first fastening end is adjacent to the other one of the pair of supporting arms. The first member has a means for receiving the protruding portion of the fusible linkage and preventing misalignment of the protruding portion. The second member is opposite to the first member and has a second connecting end and a second fastening end opposite the second connecting end. The first and second connecting ends are coupled to each other.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
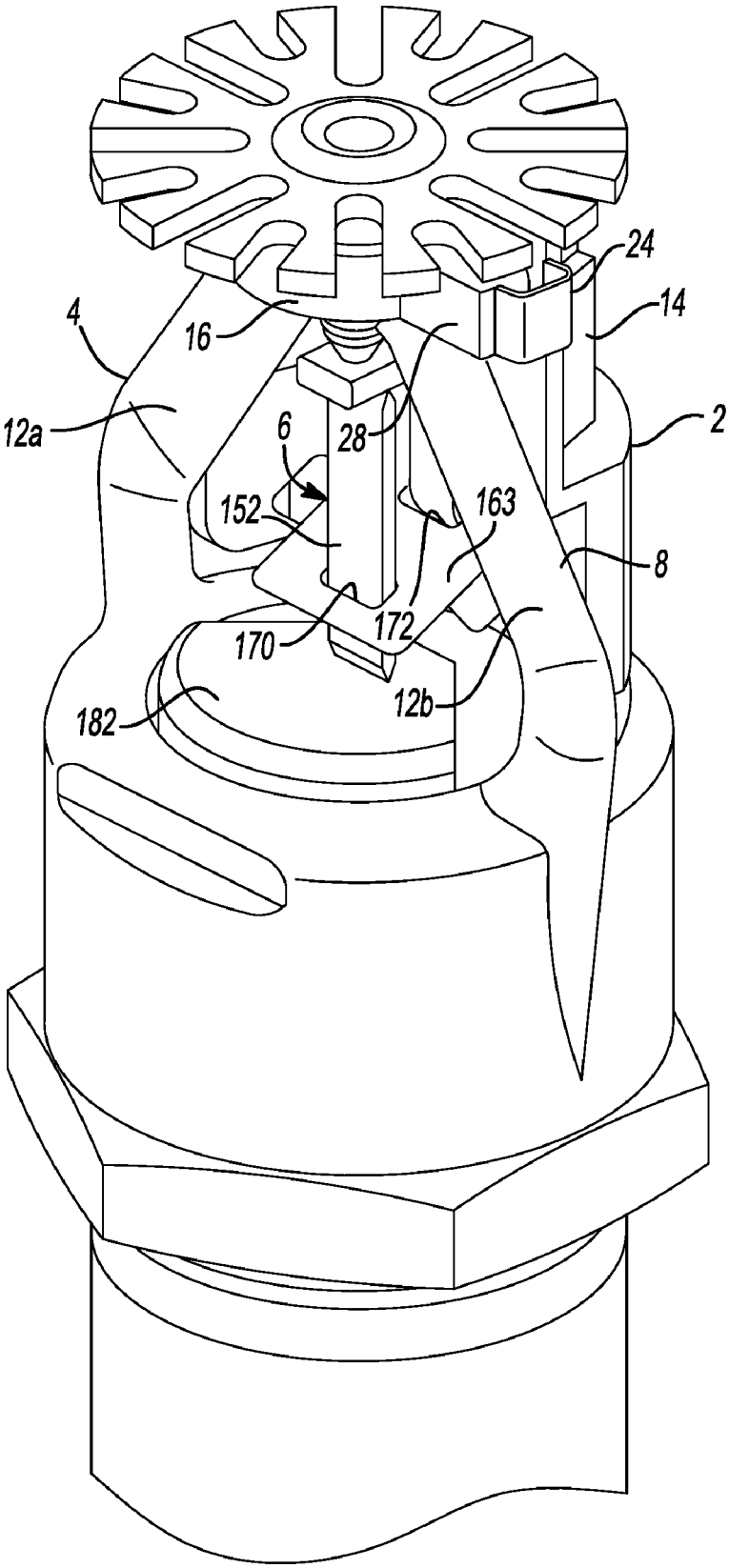
FIG. 1 is a perspective view of a combination of a cover and a sprinkler head according to the teachings of the present disclosure, the cover being in a fastened position.

The following description is merely exemplary in nature and is not intended to limit the present disclosure, application, or uses. It should be understood that throughout the drawings, corresponding reference numerals indicate like or corresponding parts and features.

With reference to FIGS. 1 through 4, a cover 2 is shown mounted to a sprinkler head 4. The sprinkler head 4 can include a fusible linkage 6 mounted within a frame 8. The frame 8 can include a pair of supporting arms 12*a* and 12*b* that each connect with an apex 13. The fusible linkage 6 is of a type which is well known in the art and as disclosed includes a protruding portion 10.

Figure 3:
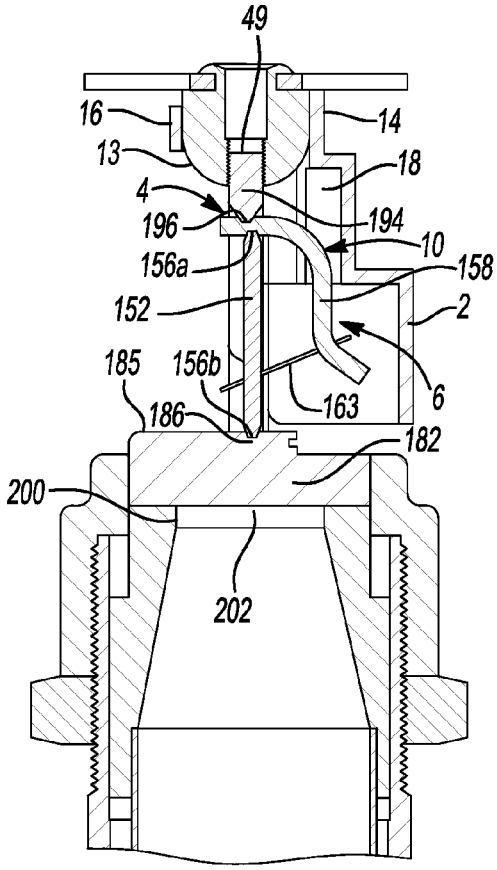
FIG. 3 is a cross-section view taken along the line 3-3 of FIG. 2.
Figure 4:
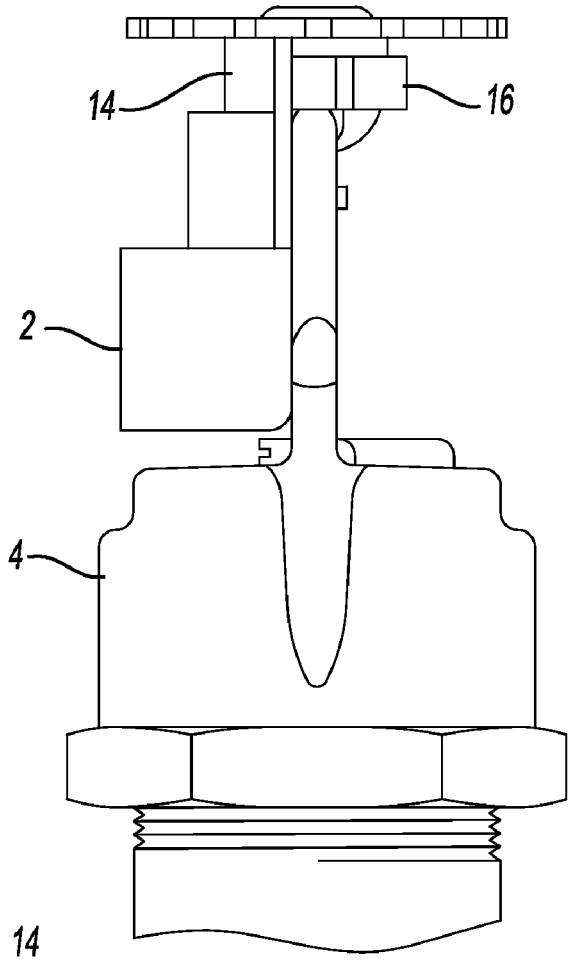
FIG. 4 is a side elevation view of the combination of the cover and the sprinkler head shown in FIG. 1.
Figure 10:
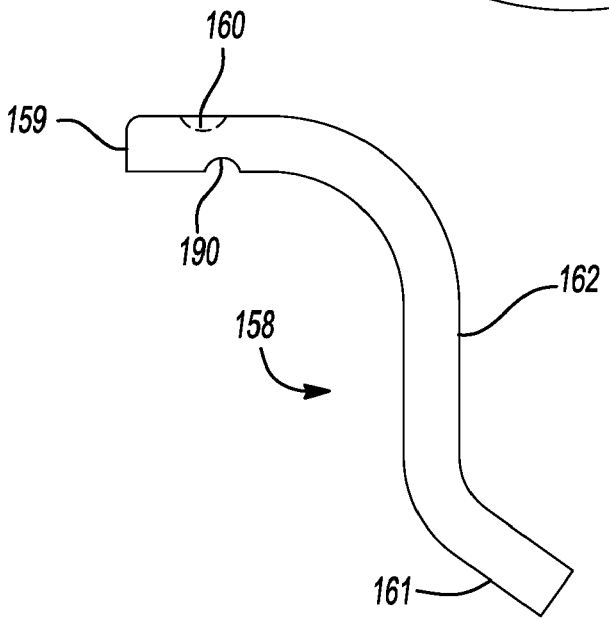
FIG. 10 is a perspective view of a second pin of a fusible linkage of the sprinkler head depicted in FIGS. 1 and 3.
Figure 11:
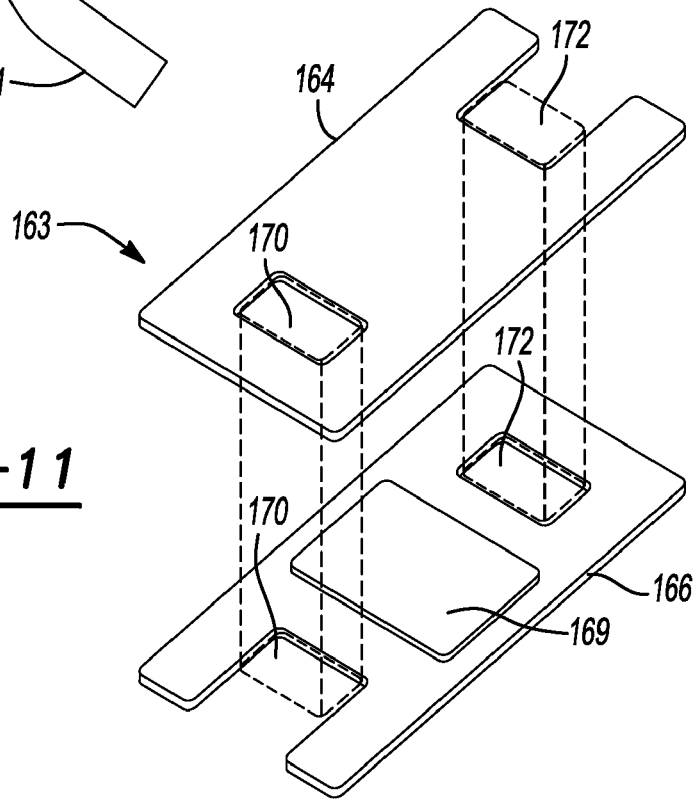
FIG. 11 is an exploded perspective view of a fusible connection of a fusible linkage of the sprinkler head depicted in FIGS. 1 and 3.

With specific reference to FIGS. 1 and 3, in this particular example, the fusible linkage 6 includes a first pin 152, a second pin 158, and a fusible connection 163. The first pin 152 is substantially linear and has a pair of opposing ends 156*a* and 156*b*, each of which is tapered. As shown in FIG. 10, the second pin 158 assumes a largely S-shaped configuration, having a top member 159 and a bottom member 161 joined by a middle member 162. The fusible connection 163 may be any thermally responsive fusible connection commonly utilized in the industry having a fusing temperature between approximately 155 degree F. and 175 degree F. As shown in FIG. 11, the fusible connection 163 includes a pair of plates 164 and 166 joined by a fusible material 169.

With reference to FIGS. 1, 3, 10, and 11, the fusible linkage 6 is assembled by inserting the first pin 152 into a hole 170 defined by the plates 164 and 166, with the end 156*b* resting within a depression 186 formed in a top surface 185 of a plug seal 182. Thereafter, the second pin 158 is positioned through a hole 172 such that the fusible connection 163 rests at the intersection of the middle member 162 and the bottom member 161 of the second pin 158. The end 156*a* of the first pin 152 is then inserted in a notch 190 positioned in the top member 159 of the second pin 158. Subsequently, a screw 194 is inserted in a bore 49 and rotated until an end 196 of the screw 194 is positioned within a depression 160 of the top member 159 of the second pin 158. Rotation of the screw 194 upon the second pin 158 exerts a force, resulting in a slight upward movement of the fusible connection 163 and a sealing engagement of the plug seal 182 over a central orifice 202 of an outlet 200.

Figure 2:
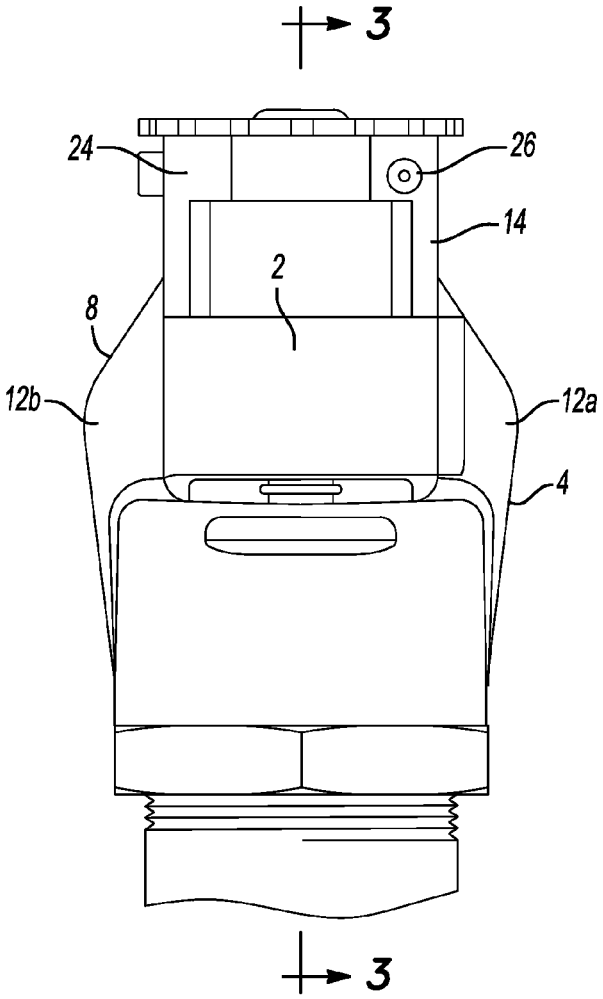
FIG. 2 is an elevation view of the combination of the cover and the sprinkler head shown in FIG. 1.
Figure 5:
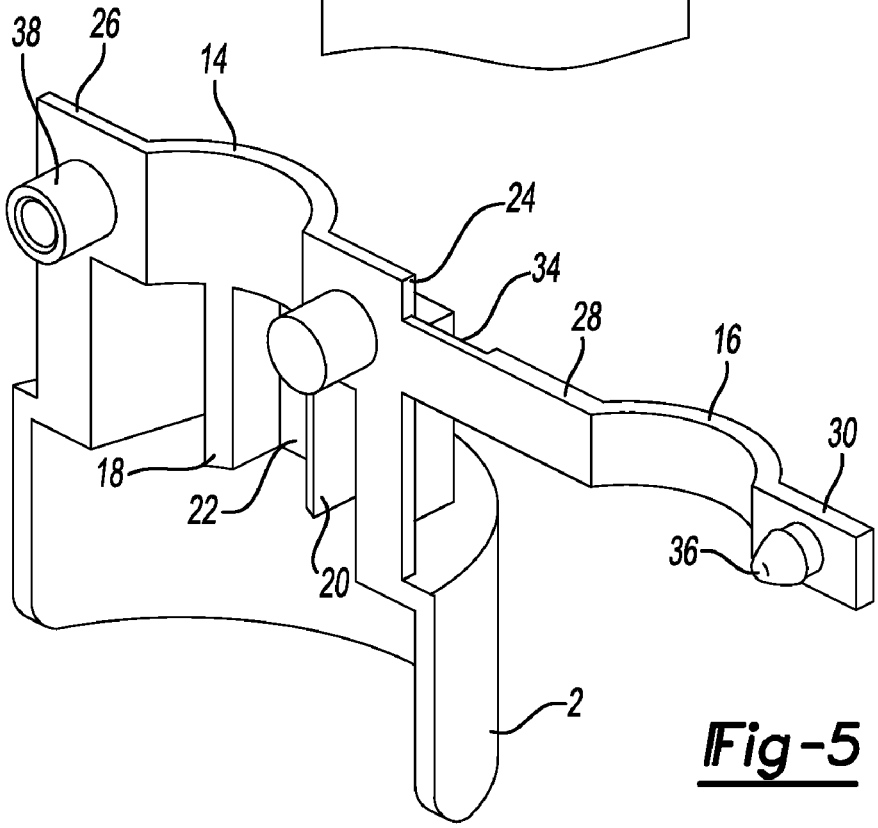
FIG. 5 is a perspective view of the cover shown in FIG. 1 in an open position.
Figure 6:
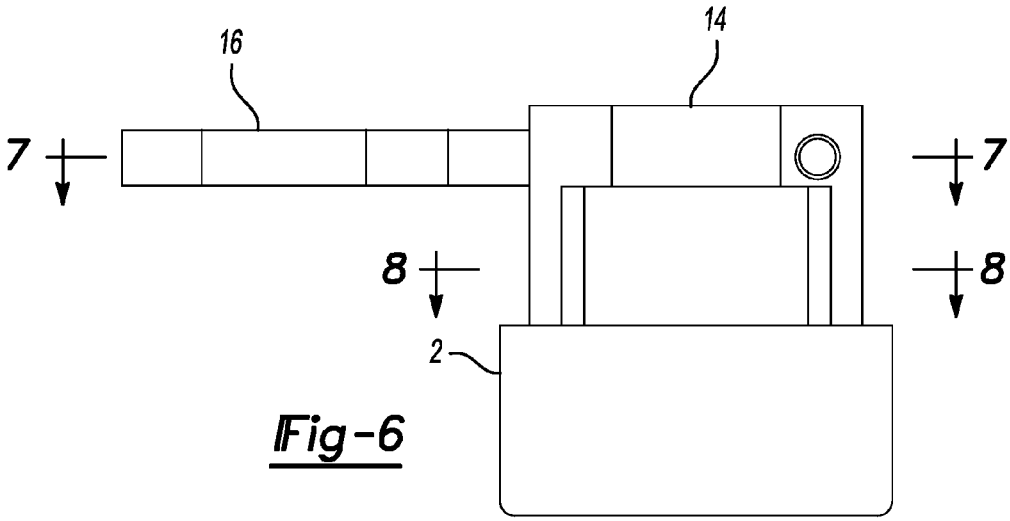
FIG. 6 is an elevation view of the cover shown in FIG. 5.

With specific reference to FIG. 5, the cover 2 can include a first member 14, a second member 16, a first projection 18, a second projection 20, and a space 22 defined between the first and second projections 18, 20. The first member 14 can be adjacent to the protruding portion 10 of the fusible linkage 6. The first member 14 can have a first connecting end 24 and a first fastening end 26 opposite the first connecting end 24. In the assembled condition, the first connecting end 24 can be adjacent to the supporting arm 12*b* and the first fastening end 26 can be adjacent to the supporting arm 12*a*, as best shown in FIGS. 1 and 2. The second member 16 can be adjacent to the apex 13 of the frame 8. The second member 16 can be opposite to the first member 14 and has a second connecting end 28 and a second fastening end 30 opposite the second connecting end 28. The first connecting end 24 and the second connecting end 28 can be coupled to each other. The first projection 18 can extend from the first member 14 toward the second member 16. The second projection 20 can extend from the first member 14 toward the second member 16 and can be in spaced relation to the first projection 18. The space 22 can be defined between the first projection 18 and the second projection 20 for receiving the protruding portion 10 of the fusible linkage 6. The first projection 18 and the second projection 20 can engage the protruding portion 10 of the fusible linkage 6. Moreover, the pair of supporting arms 12*a* and 12*b* can be disposed generally in a plane. The protruding portion 10 of the fusible linkage 6 can project from the plane toward the first member 14 and into the space 22 defined between the first and second projections 18, 20. Furthermore, the cover 2 can be made of a resilient material, such as plastic.

Figure 7:
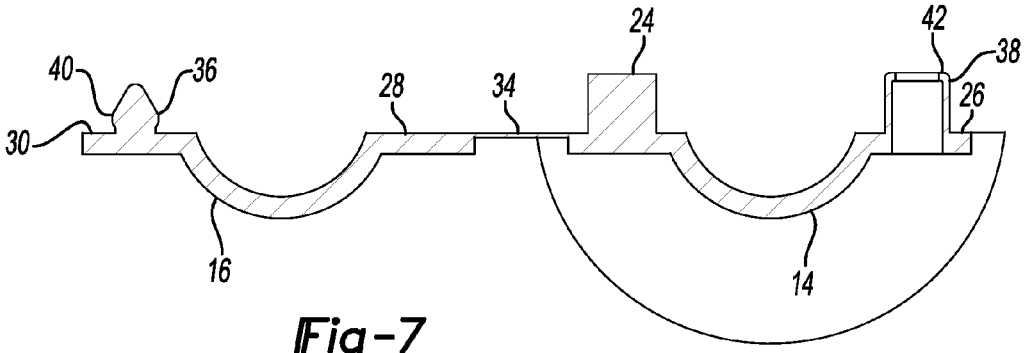
FIG. 7 is a cross-section view taken along the line 7-7 of FIG. 6.

With reference to FIGS. 5 through 8, the cover 2 can comprise a hinge coupling the first connecting end 24 and the second connecting end 28 to each other. The hinge can comprise a living hinge 34, as best shown in FIG. 7. The living hinge 34 is made of a thin section of resilient material, such as plastic. Other forms of hinges, such as piano hinges, socket and trunnion hinges and the like, can also be used. Moreover, the cover 2 can have a releasable fastener disposed between the first fastening end 26 and the second fastening end 30. The releasable fastener can comprise a latching pin 36 and a receiving pin 38. The latching pin 36 can extend from the second fastening end 30 toward the first fastening end 26 when the cover 2 is in a fastened position. The receiving pin 38 can extend from the first fastening end 26 toward the latching pin 36. The latching pin 36 can be interlocking within the receiving pin 38 to releasably secure the first fastening end 26 and the second fastening end 30 together.

With specific reference to FIG. 7, in this particular example the latching pin 36 has a lip 40. The receiving pin has a rim 42. The diameter of the lip 40 is just a little bigger than the one of the rim 42, thus allowing the latching pin 36 and the receiving pin 38 to be releasably coupled together. It can be appreciated that other types of fasteners, such as nuts and bolts, hook and loop systems, latches and the like, could also be used to releasably secure the first fastening end 26 and the second fastening end 30 together.

Figure 8:
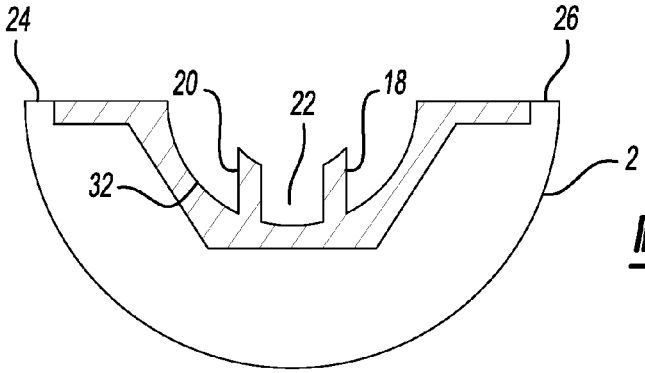
FIG. 8 is a cross-section view taken along the line 8-8 of FIG. 6.

With specific reference to FIG. 8, the first member 14 can include a shield portion 32 disposed between the first connecting end 24 and the first fastening end 26. The first projection 18 and the second projection 20 can extend from the shield portion 32 for defining the space 22 therebetween for receiving the protruding portion 10 therein for preventing the fusible linkage 6 from becoming misaligned from its preferred orientation. The shield portion 32 can have a semicylindrical, trapezoidal, or other shape.

Figure 9:
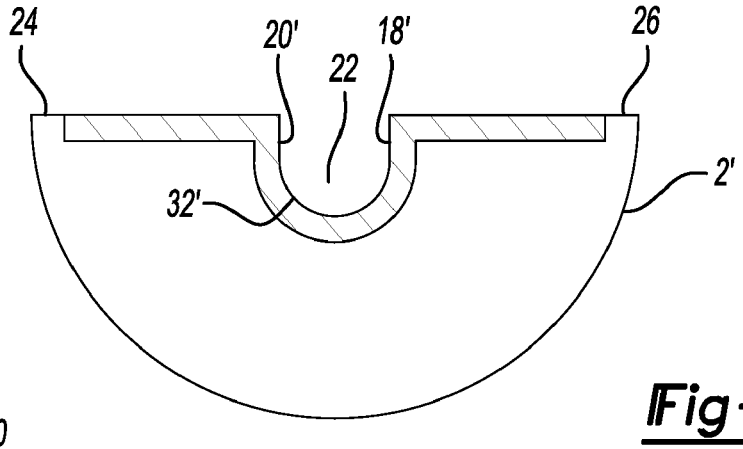
FIG. 9 is a cross-section view similar to that of FIG. 8 but illustrating an alternately constructed cover.

With specific reference to FIG. 9, an alternately constructed shield portion 32' of a modified cover 2' is shown. Except as described herein, the cover 2' can be similar to the cover 2 described above and illustrated in FIGS. 1 through 8. FIG. 9 illustrates the shield portion 32' with side wall portions 18', 20' forming a portion of shield portion 32' and defining a space 22 therebetween for receiving the protruding portion 10 of the fusible linkage 6 and preventing the fusible linkage 6 from becoming misaligned from its preferred orientation.

What is claimed is:

1. In combination, a cover and a sprinkler head, the sprinkler head comprising a fusible linkage mounted within a frame, the fusible linkage comprising a protruding portion, the frame comprising a pair of supporting arms, the cover comprising:

a first member adjacent to the protruding portion of the fusible linkage, the first member having a first connecting end and a first fastening end opposite the first connecting end, the first connecting end being adjacent to one of the pair of supporting arms, the first fastening end being adjacent to the other one of the pair of supporting arms;

a second member opposite to the first member and having a second connecting end and a second fastening end opposite the second connecting end, the first and second connecting ends being coupled to each other;

a first projection extending from the first member toward the second member; and a second projection extending from the first member toward the second member and being in spaced relation to the first projection, a space being defined between the first projection and the second projection for receiving the protruding portion of the fusible linkage, the first and second projections being in close proximity to the protruding portion of the fusible link and preventing misalignment of the protruding portion of the fusible linkage.

2. The combination according to claim 1, wherein the first member includes a shield portion disposed between the first connecting end and the first fastening end, the first and second projections extending from the shield portion.

3. The combination according to claim 2, wherein the shield portion has a semi-cylindrical shape.

4. The combination according to claim 2, wherein the shield portion has a trapezoidal shape.

5. The combination according to claim 1, wherein the first and second projections engage the protruding portion of the fusible linkage.

6. The combination according to claim 5, wherein the cover is made of a resilient material.

7. The combination according to claim 6, wherein the resilient material is plastic.

8. The combination according to claim 1, the cover further comprising a hinge coupling the first and second connecting ends to each other.

9. The combination according to claim 8, the cover further comprising a releasable fastener disposed between the first and second fastening ends.

10. The combination according to claim 9, wherein the releasable fastener comprises:

a latching pin extending from one of the first and second fastening ends toward the other one of the first and second fastening ends; and a receiving pin extending from the other one of the first and second fastening ends toward the latching pin, the latching pin being interlocking within the receiving pin to releasably secure the first and second fastening ends together.

11. The combination according to claim 10, wherein the cover is made of a resilient material.

12. The combination according to claim 11, wherein the resilient material is plastic.

13. The combination according to claim 12, wherein the hinge comprises a living hinge.

14. The combination according to claim 1, wherein the pair of supporting arms are disposed generally in a plane.

15. The combination according to claim 14, wherein the protruding portion of the fusible linkage projects from the plane toward the first member.

16. The combination according to claim 1, wherein the first and second members are engaging an apex portion of the frame.

17. The combination according to claim 1, wherein the first and second projections extend between an apex portion of the frame and a central portion of the protruding portion.

* * * * *